US008801310B2

(12) United States Patent
Kulik

(10) Patent No.: US 8,801,310 B2
(45) Date of Patent: Aug. 12, 2014

(54) MULTIPLE WIPER

(71) Applicant: GEKA GmbH, Bechhofen (DE)

(72) Inventor: Daniela Kulik, Leipzig (DE)

(73) Assignee: GEKA GmbH, Bechhofen (DE)

( * ) Notice: Subject to any disclaimer, the term of this patent is extended or adjusted under 35 U.S.C. 154(b) by 0 days.

(21) Appl. No.: 13/655,754

(22) Filed: Oct. 19, 2012

(65) Prior Publication Data

US 2013/0101336 A1 Apr. 25, 2013

(30) Foreign Application Priority Data

Oct. 19, 2011 (DE) ..... 20 2011 051 673 U

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)
USPC ..... 401/122

(58) Field of Classification Search
USPC ..... 401/121, 122; 220/229, 254.2
See application file for complete search history.

(56) References Cited

U.S. PATENT DOCUMENTS

| | | | | |
|---|---|---|---|---|
| 5,052,837 | A * | 10/1991 | Iizuka et al. | 401/4 |
| 5,349,972 | A | 9/1994 | Dirksing et al. | |
| 5,490,737 | A * | 2/1996 | Gueret | 401/122 |
| 6,568,405 | B2 * | 5/2003 | Masuyama | 132/218 |
| 7,578,071 | B2 * | 8/2009 | Goldstein et al. | 33/725 |
| 2009/0052969 | A1 * | 2/2009 | Gueret | 401/122 |

FOREIGN PATENT DOCUMENTS

DE 19520134 B4 2/2005

* cited by examiner

*Primary Examiner* — David Walczak
*Assistant Examiner* — Joshua Wiljanen
(74) *Attorney, Agent, or Firm* — Setter Roche LLP

(57) ABSTRACT

The invention relates to a wiper for wiping off a cosmetics applicator that includes a retaining section for fixing the wiper on a cosmetics storage container. The wiper includes several wiping organs disposed one behind the other in an operative direction, of which at least one wiping organ is retained on the retaining section or on an adjacent wiping organ either in such a way that that the at least one wiping organ communicates unimpededly both on its front as well as on its rear with a space storing a cosmetic, or only by a plurality of columns.

23 Claims, 6 Drawing Sheets

MULTIPLE WIPER

FIELD OF THE INVENTION

The invention relates to a wiper. Such wipers are in use in a variety of forms for wiping off cosmetics applicators which, so long as they are not in use, dip into a cosmetics supply from which they are withdrawn in order to make the applicator ready for use.

BACKGROUND OF THE INVENTION

An ever recurring problem is caused by the fact that an applicator heavily charged with cosmetics mass prevents air from flowing into the storage container during the withdrawal of the applicator from the cosmetics supply, because the cosmetics applicator and its charge provide an almost air-tight seal against the wiper lip. Thus, a negative pressure builds up in the cosmetics storage container which collapses abruptly once the distal end of the applicator, i.e. the end facing away from the handle, has passed the wiper lip. The abrupt collapse of the negative pressure causes a loud noise which, onomatopoetically, can be described as a "pop". This noise is often perceived as being in conflict with the high-quality visual and haptical design of the cosmetics unit. In this case, what is even more annoying is the fact that the sudden pressure equalization not infrequently leads to clearly perceptible drops of the cosmetic squirting out of the region of the cosmetics storage container close to the opening, or to the distal end of the applicator being overcharged with mascara mass, preventing a neat application.

In order to remedy this, various solutions have been proposed in the past. These solutions all tend to go in the same direction—smaller gaps or openings in a lateral region of the wiper and/or interruptions in the wiper lip itself are provided which form a sort of "bypass", which ensures that air is able to continuously flow into the cosmetics storage container, so that no or only a small negative pressure is able to build up. However, the problem is that it is difficult to ensure that the smaller gaps, openings or interruptions really do not get congested with cosmetic mass depositing in front of or behind the wiper, possibly drying there, as a consequence of multiple withdrawal and reinsertion of the cosmetics applicator, which is almost never completely discharged.

In view of this, the invention is based on the object of providing a wiper, or a cosmetics unit provided with the wiper, which permanently exhibits a reduced tendency for noise development and/or squirting upon withdrawal of the applicator, or which relieves the applicator of excess cosmetic at the distal end.

SUMMARY OF THE INVENTION

According to the invention, a wiper is proposed for wiping off a cosmetics applicator with a preferably tubular retaining section for fixing the wiper on a cosmetics storage container, which comprises several wiping organs disposed one behind the other in the operative direction—i.e., as a rule, in the removal direction of the cosmetics applicator—of which at least one wiping organ is retained on the retaining section or on the adjacent wiping organ in such a way that it communicates unimpededly both on its front as well as on its rear with the space storing the cosmetic. Such unimpeded communication is provided in any case if, directly next to the wiping organ, preferably over the shortest possible distance, a direct connection is established between the front (seen in the removal direction) of the wiping organ and the rear of the wiping organ. In this case, the clear cross section of the connection is so large that there is no threat of a complete clogging up of the connection even over the duration of the intended use of the respective cosmetics unit. Such a shortest possible connection is provided, for example, if the respective wiping organ is a disc-shaped body and if a connection is provided directly along the circumferential edge of the disc-shaped body between its front and its rear.

Another version of the wiper according to the invention preferably used for solving the problem according to the invention provides a wiper for wiping off a cosmetics applicator, comprising a preferably tubular retaining section for fixing the wiper on a cosmetics storage container. In this case, the wiper comprises several wiping organs disposed one behind the other in the operative direction, of which at least one wiping organ is retained on the retaining section or on the adjacent wiping organ only by means of several columns. In this way, large "windows" can be realized laterally in the vicinity of the, optionally also funnel-shaped, wiping organ, which bring about or promote the effect desired according to the invention.

Within the context of a preferred embodiment, it is provided that at least one wiping organ of the wiper, better at least two wiping organs of the wiper, is/are configured as a disc disposed perpendicularly to the longitudinal wiper axis L. In any case, a structure is deemed to be a disc in this sense whose extent in the direction parallel to the longitudinal axis is no more than 5.5 times, better no more than 3 times, the maximum wall thickness in the direction parallel to the wall thickness.

Preferably, the main surface facing into the container of one or more of said discs is substantially conical.

Within the context of a preferred embodiment, it is provided that at least one wiping organ of the wiper, better at least two wiping organs of the wiper, comprise a number of slits dividing the respective wiping organ into several segments, the segments preferably being configured like pieces of cake whose tips are centrally opposite or meet centrally, and which rest against one another with their flanks or are separated only by a small gap. In any case, a gap is small within the sense of this development if its maximum width is no greater than 1 mm, and preferably no greater than 0.5 mm.

Preferably, at least one wiping organ of the wiper, better two wiping organs of the wiper, comprise(s) a central opening which is always open so long as no cosmetics applicator protrudes through the respective wiping organ.

Preferably, the segments of the segmented wiping organ are configured in such a way that they form unilaterally clamped bending beams, which bend in an elastically yielding manner in the direction of the traction force during withdrawal of the cosmetics applicator, with the spring force counteracting the bending being so large that the segments snap back substantially into their undeflected position already when the cosmetics applicator, during its withdrawal, has passed the respective wiping organ predominantly, but not yet completely.

In this case, ideally the thickness of the segments forming the unilaterally clamped bending beams respectively decreases in the direction from their fixing site towards their free end. It is thus ensured that the central region of each ending beam does not exert too great a pressure on the bristle covering or on the wiper region taking its place, and thus does not exhibit an excessive wiping action anywhere.

Preferably, the retaining section forms a further wiping organ. This is best done by it forming a tubular body which tapers at the end thereof facing into the container in such a way that the taper forms a circular wiper lip which is ideally completely closed in itself in the circumferential direction. With such an additional wiper, it can be ensured that the stem of the applicator is being optimally wiped off. Given a proper dimensioning, which is preferably to be provided, the stem is wiped off without an excessive wiping action being exercised by this wiping organ in the region of the bristle covering, for whose proper wiping the other wiping organ is responsible, at least to a predominant extent.

Preferably, the tubular body is completely closed at its circumference and thus forms a wiper antechamber which communicates with the space storing the cosmetic, substantially, and preferably exclusively, via the wiper opening rimmed by the wiper lip.

Within the context of a preferred solution, which, however, is completely alternative to the previous proposals, it is provided that the wiper comprises several wiping organs disposed one behind the other in the operative direction, with one of these wiping organs being configured as a disc which is disposed wholly or substantially perpendicularly to the longitudinal wiper axis, which is preferably slitted, and another one of the wiping organs is formed by a tubular body which tapers at the end thereof facing into the container in such a way that the taper forms a circular wiper lip which is ideally completely closed in itself in the circumferential direction.

One development of the invention provides that the slits are partially, or preferably all, not straight but preferably configured so as to form an S-shaped profile.

Additional protection is preferably sought for a system consisting of a cosmetics storage container and a wiper fixed thereon, wherein at least one wiping organ freely protrudes into the interior of the cosmetics storage container without being in immediate contact with the wall or walls of the cosmetics storage container, the system preferably also comprising a cosmetics applicator.

Preferably, such a system is configured in such a way that said wiping organ keeps a minimum distance, all around, of at least 1 mm, better 3 mm, to the wall or walls of the cosmetics storage container.

Further advantages, mechanisms of action and optional embodiments of the inventions are evident from the following description of three exemplary embodiments with reference to the Figures listed below.

DETAILED DESCRIPTION OF THE PREFERRED EMBODIMENTS

Figure 2:
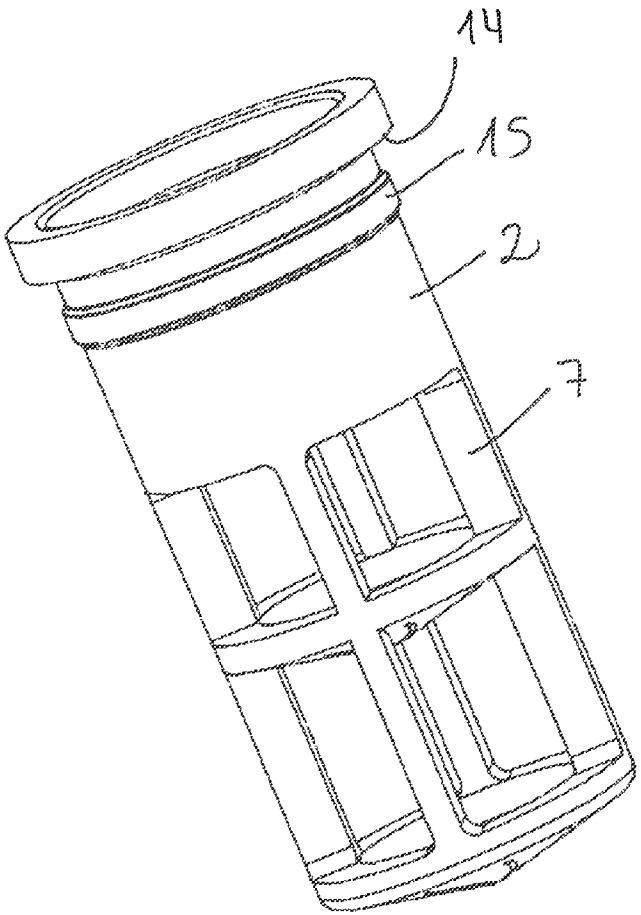
FIG. 2 shows a perspective side view of the first exemplary embodiment of the wiper according to the invention.
Figure 1:
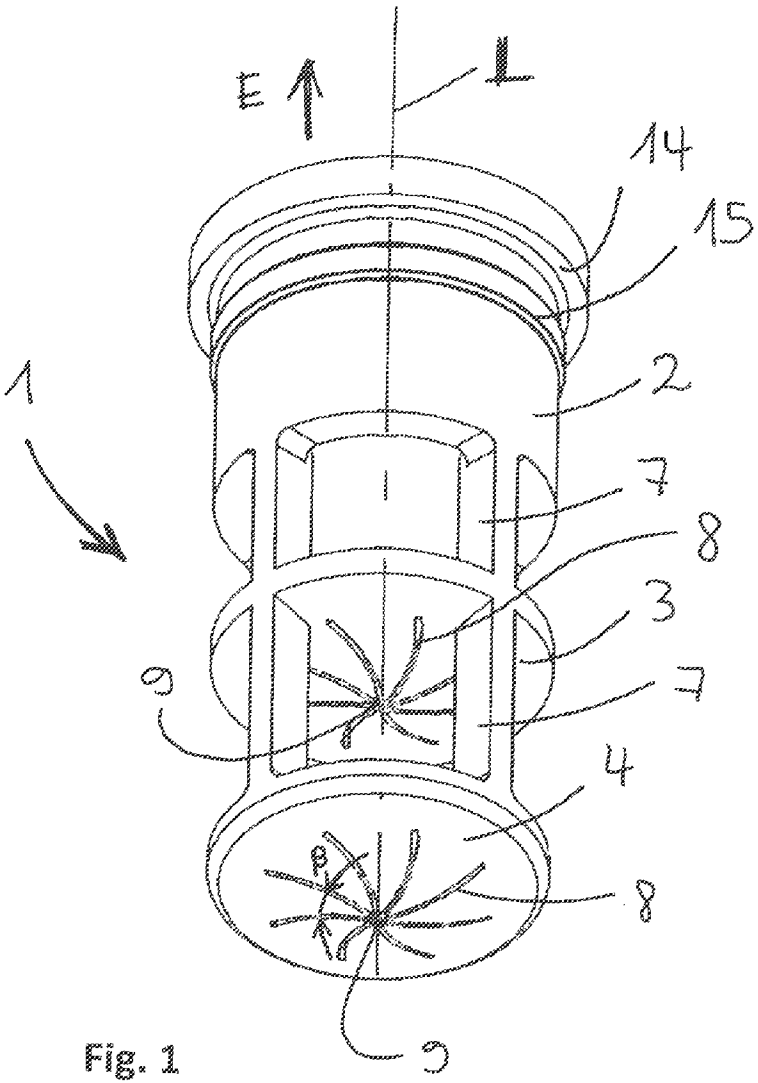
FIG. 1 shows a side view of a first exemplary embodiment of the wiper according to the invention, inserted into the neck of a bottle serving as a cosmetics storage container.

As can be seen rather well in FIG. 1, the wiper 1 of the first exemplary embodiment consists of a retaining section 2 and two wiping organs 3 and 4.

As is preferred, the retaining section 2 is in this case configured as a tubular body which is completely closed in itself in the circumferential direction, and by means of which the wiper 1 is fixed in the neck of the bottle 13, which in this case serves as the cosmetics storage container. For this purpose, the retaining section 2 is preferably provided with a collar-like stop 14, which abuts against an end face of the bottle neck and thus limits the distance by which the wiper 1 can be inserted into the bottle neck, and which, at the same time, acts as a gasket in order thus to prevent the cosmetic from leaking out from the container. As can be seen, the retaining section 2 is additionally provided with at least one latching organ 15 which engages with a corresponding latching organ or a corresponding surface of the bottle neck. The external diameter of the retaining section 2 is generally adapted to the internal diameter of the bottle neck provided for accommodating it, in order thus to ensure a clearance-free seat of the wiper 1 also in the radial direction. In this exemplary embodiment, the retaining section 2 has a substantially constant internal diameter, i.e. the retaining section 2 as such does not contribute to the wiping action in any substantial extent. At the end thereof facing into the container, the retaining section 2 transitions into several columns 7. A wiping organ 3 is attached to the retaining section 2 by means of these columns 7.

In this case, the wiping organ 3 is configured as a disc, which is preferably circular. A disc within the sense of the invention is a structure possessing two large main surfaces and a circumferential surface, which in comparison thereto is small. In this case, the two main surfaces are disposed in such a way that they stand perpendicularly on the longitudinal wiper axis L.

Preferably, the disc is slightly conical, i.e. at least one of its two large main surfaces, preferably, however, both large surfaces, are not oriented absolutely perpendicularly to the longitudinal wiper axis L, but rather preferably extend at an angle of 90°+/− max. 15°, and ideally at an angle of 90°+/− max. 10°, relative to the longitudinal wiper axis L. Ideally, the two main surfaces are conical in such a way that, towards the center of the disc, they are slightly inclined in the direction facing into the container. This facilitates the reinsertion of the applicator.

In the direction parallel to the longitudinal axis, the disc preferably has a thickness of between 0.5 to 1.75 mm, with this range, despite the thickness of the disc decreasing towards the center, not having to be made use of completely. It is provided with a number of slits which extend from the center of the disc to the edge of the disc. In the preferred exemplary embodiment shown in FIGS. 1 to 4, two slits, respectively, which are immediately opposite from each other in the central area, form an S-shaped slit arrangement, whereby an improved wiping action is generated, surprisingly, as compared with slits that extend exclusively in a straight manner. Due to the straight or S-shaped slits, the predominant part of the large main surfaces is divided into unilaterally clamped bending beams, which have a triangular form of a piece of cake and which, like the pieces of a cake, are arranged in a circle. The acute angle of each bending beam on the side thereof facing towards the center is preferably in a range for which the following applies: $42° \leq \beta \leq 28°$. Tips configured in this way "comb" the applicator very effectively and therefore lead to a particularly good wiping result, especially in the case of bristle-covered applicators.

Figure 3:
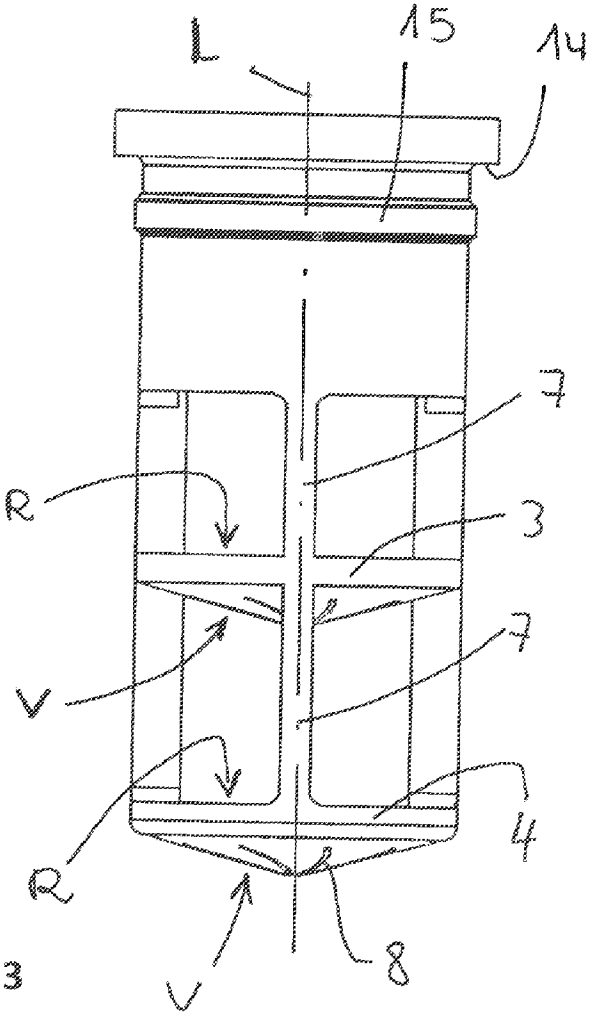
FIG. 3 shows a perspective side view of the first exemplary embodiment of the wiper according to the invention in a section along the longitudinal wiper axis L.
Figure 6:
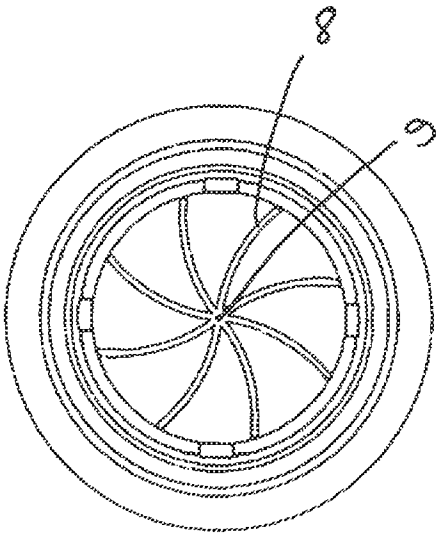
FIG. 6 shows a perspective side view of the second exemplary embodiment of the wiper according to the invention.
Figure 5:
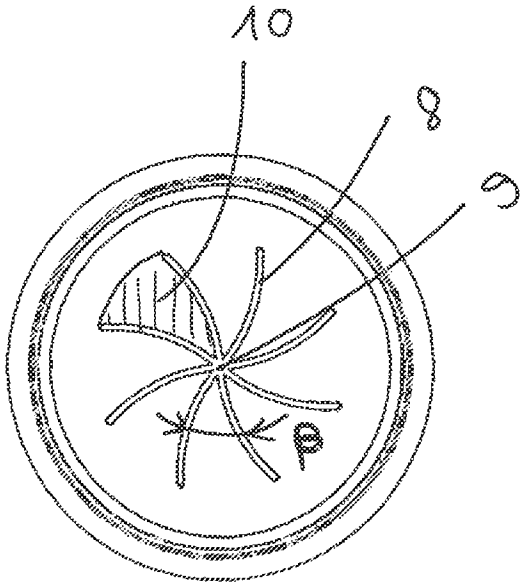
FIG. 5 shows a side view of a second exemplary embodiment of the wiper according to the invention.
Figure 8:
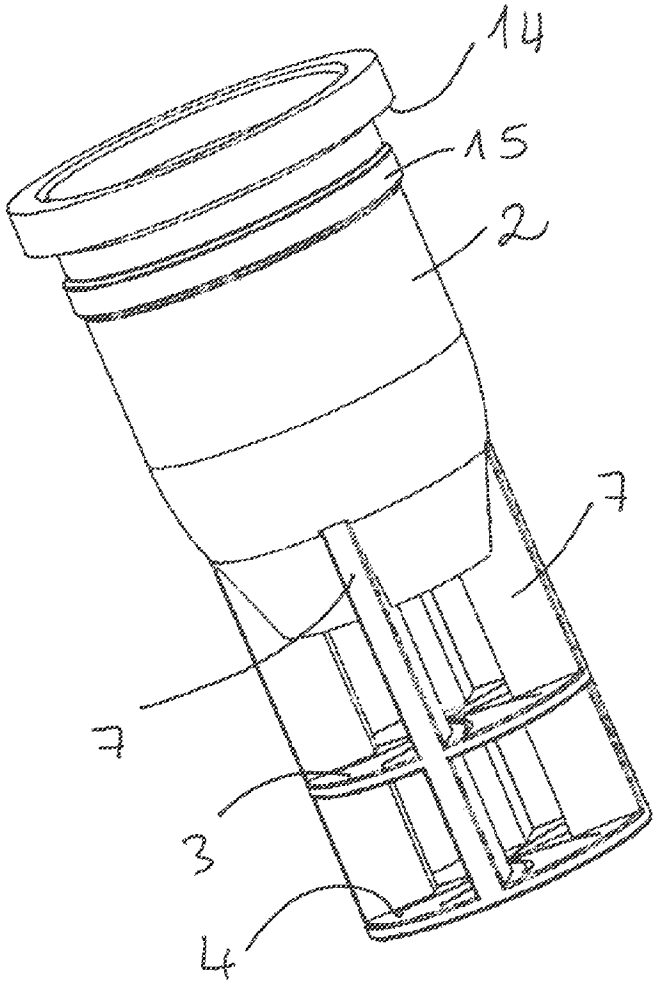
FIG. 8 shows a top view of the wiper organ facing into the container of the wiper, which in this case represents the second exemplary embodiment.
Figure 7:
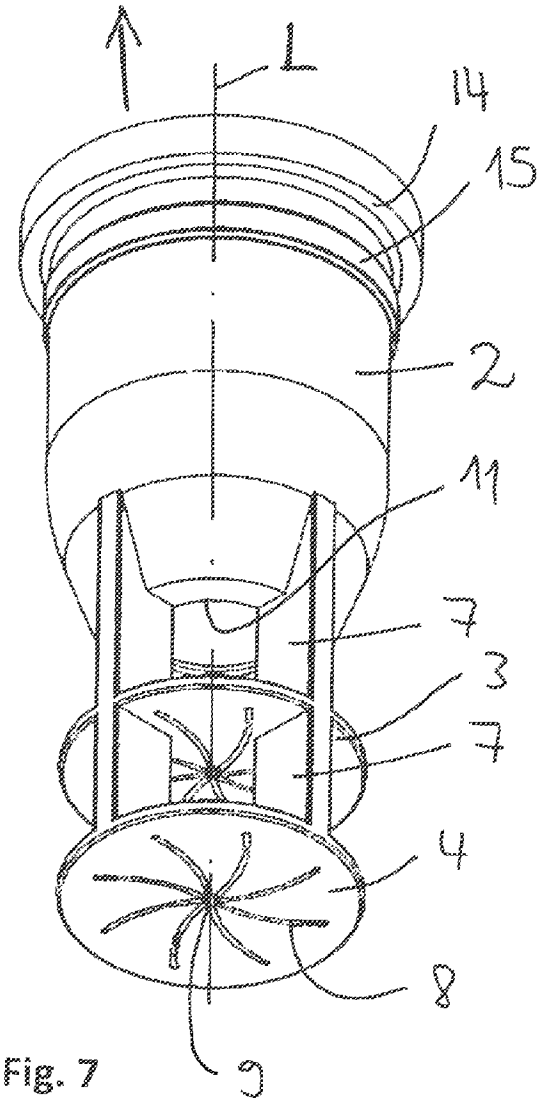
FIG. 7 shows a perspective side view of the second exemplary embodiment of the wiper according to the invention in a section along the longitudinal wiper axis L.
Figure 10:
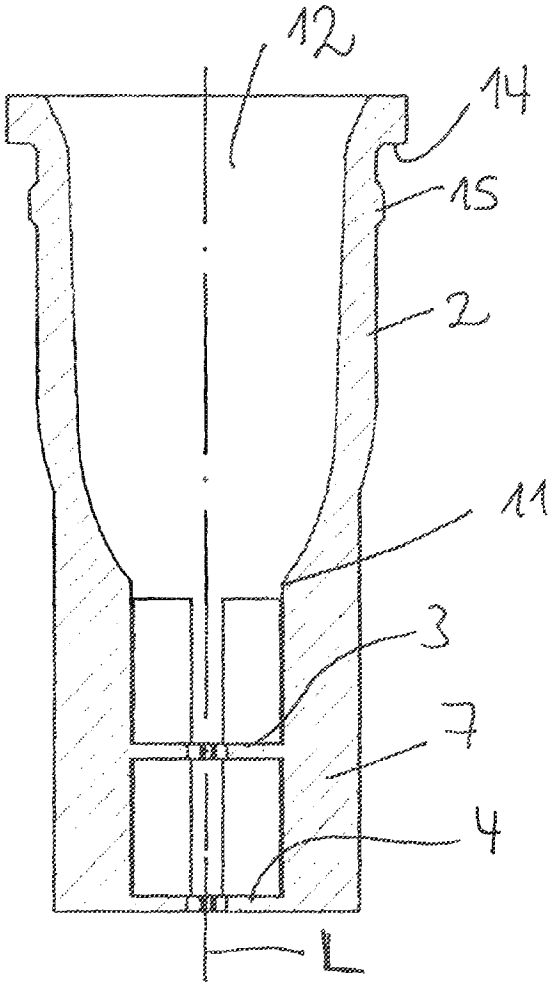
FIGS. 9 to 12 show a third exemplary embodiment of the invention.
Figure 9:
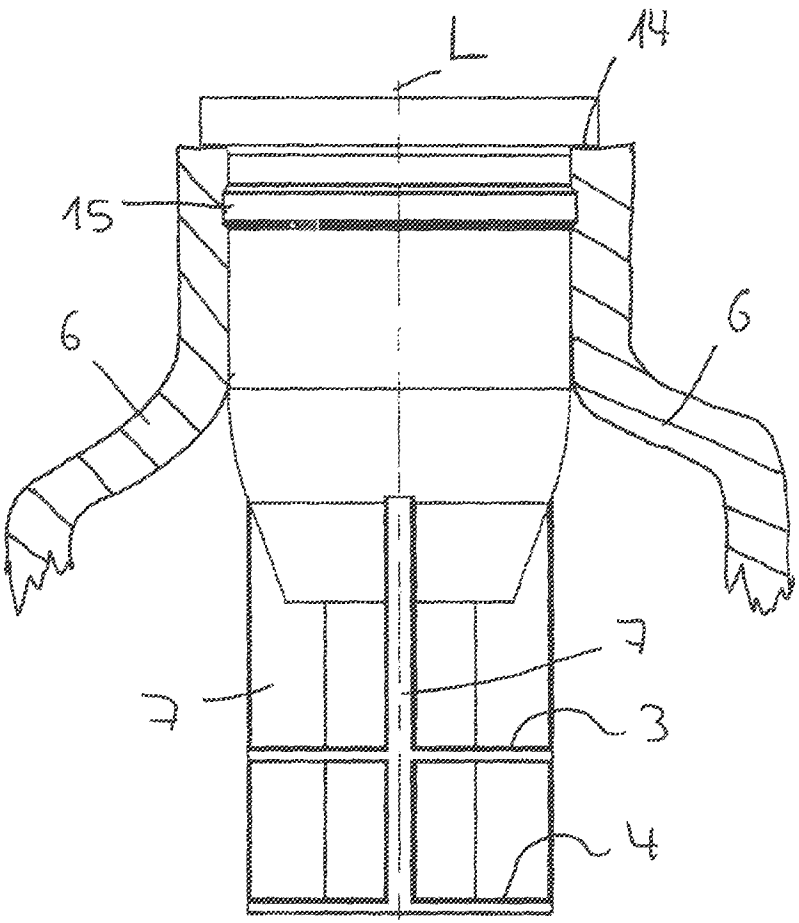
Figure 12:
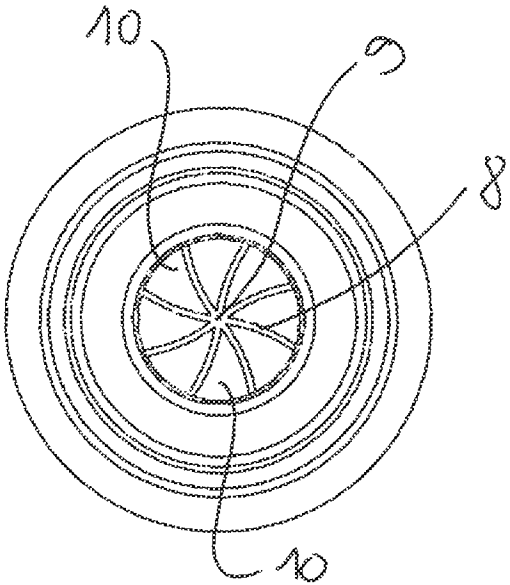
Figure 11:
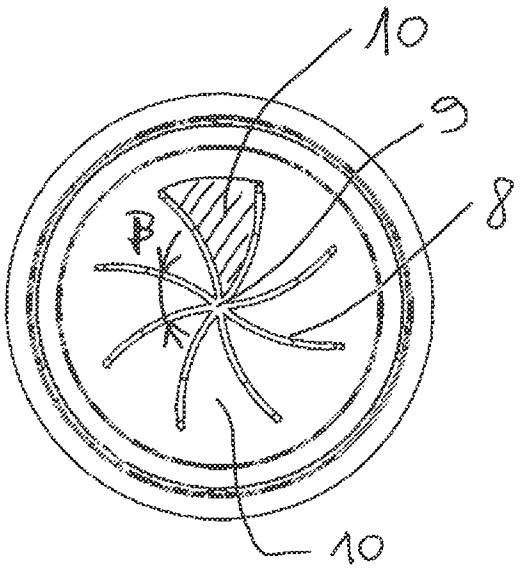

As can best be seen in FIG. 3, the thickness of the disc decreases from its outer circumference towards the center of the disc, which has a positive effect on the deformation behavior of the wiping organ or its bending beams. When the cosmetics applicator is being withdrawn, the bending beams bend in an elastically yielding manner. In the process, the spring force counteracting the bending preferably is so large that the segments snap back substantially into their undeflected position already when the cosmetics applicator, during its withdrawal, has passed the respective wiping organ predominantly, but not yet completely. Thus, in particular the free end of the applicator facing away from the applicator handle is wiped off very effectively.

Preferably, the slits at their outer sides end at an imaginary circle with a radius which constitutes about ¾ of the maximum disc radius, so that, despite the slits, the disc still has the required inherent stability and does not "turn inside out" permanently when the applicator is pulled through it. The disc is perforated in its center. In this case, the diameter of the hole, which the disc facing into the interior of the container has, is preferably larger (ideally by at least 20%, better by at least 30%) than the diameter of the hole which the disc facing towards the opening of the container, which will be addressed below, has.

As was already stated above, the wiping organ 3 is held in position on the retaining section 2 by means of several columns 7. These columns 7 are each preferably quadrilateral rods, i.e. structures whose length parallel to the longitudinal axis L of the wiper 1 is considerably bigger than their width in the circumferential direction. Preferably, the rods are each so slim that their extent RE in the circumferential direction constitutes maximally 7.5%, and preferably maximally 5%, of the circumference along which the rods are placed. In individual cases, the rods can be broader and in each case constitute maximally 10% of the circumference; however, such an embodiment is not preferred but is actually only an exception for which protection is sought only secondarily. Ideally, the number of rods retaining a wiping organ 3 is limited, so that a maximum of 4 of such rods is provided for a single wiping organ 3. In individual cases, up to 6 such rods can be provided for a wiping organ 3, in which case, however, each rod should, as a rule, have an extent RE that constitutes maximally 5% of the circumference, and better constitutes maximally 3% of the circumference. As a rule, the columns are distributed uniformly along the circumference.

Figure 4:
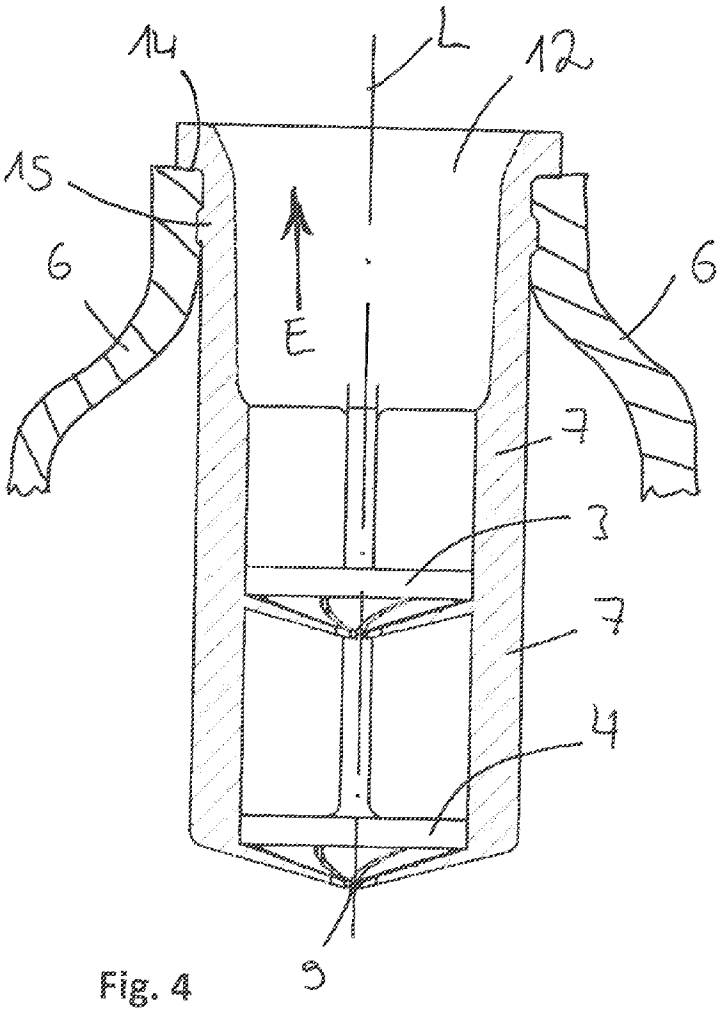
FIG. 4 shows a top view of the wiper organ facing into the container of the wiper, which in this case represents the first exemplary embodiment.

It is to be noted that the columns are preferably configured in such a way that they have a thickness in the radial direction that is greater than the wall thickness of the retaining section 2 measured in the radial direction. FIG. 4 illustrates this rather well, for it shows that the columns protrude on the inside over the inner surface of the retaining section 2 in this embodiment.

As can best be seen in FIG. 1, large lateral "window areas" are created in this manner, via which the wiping organ is able to communicate unimpededly with the space storing the cosmetic of the storage container—which means nothing else than that no perceptible pressure difference between the front and the rear of the wiper element is able to build up during the withdrawal of the cosmetics applicator through the wiping organ. This is ensured even if larger amounts of wiped-off cosmetic have accumulated at the edges of the wiping organ 3. For the "window areas" are so large that the cosmetic mass that accumulates at the edges of the wiping organ 3 due to wiping drips or drops back into the storage space before the window areas are clogged by it. This makes it possible to remove from the respective wiping organ, particularly from the tip of the applicator, a larger amount of excess cosmetic, without a "popping effect" occurring, which is undesired for application-related and sound-related reasons, because it promotes squirting and sounds unpleasant, and which is caused by pressure differences between the front and the rear of a wiping organ.

Apart from the deviations that will be described in more detail below, the previous description relating to the wiping organ 3 also applies to the wiping organ 4, and preferably also to every further disc-shaped wiping organ if provided in the individual case—with two disc-shaped wiping organs placed in series being the optimum for most cases, so that protection is sought therefor with preference.

The wiping organ 4 is also configured as a disc in the manner described above for the wiping organ 3. The wiping organ 4 is also retained on the preceding wiping organ 3 by means of columns. For this reason, the wiping organ 4 is able to communicate unimpededly with the space storing the cosmetic of the storage container. The preferably sole difference to the wiping organ 3 is that the diameter of the hole that the central hole of this disc-shaped wiping organ has is greater than that of the disc-shaped wiping organ 3. Not least for this reason, the wiping organ 4 is capable of wiping off yet a certain part of the cosmetic mass from the applicator that has at first passed the wiping organ 3 without having been wiped off.

FIGS. 5 to 8 show a second exemplary embodiment of the invention. This second exemplary embodiment of the invention is configured in substantially the same way as the first exemplary embodiment of the invention. For this reason, the statements relating to the first exemplary embodiment of the invention apply in the same way unless otherwise evident from the differences described below.

The second exemplary embodiment differs from the first exemplary embodiment in three aspects:

In this exemplary embodiment, the disc-shaped wiping organs have a constant thickness parallel to the direction of the longitudinal axis L.

Moreover, the disc-shaped wiping organs in this exemplary embodiment are completely plane, i.e. they are not conical, but their two large main surfaces are in each case oriented orthogonally to the longitudinal axis L.

Moreover, the retaining section 2 in this exemplary embodiment is formed in such a way that it tapers towards the inside of the container and forms a circular wiper lip, which is closed in itself in the circumferential direction. For this purpose, the retaining section 2 is shaped in a conical manner at the end thereof inside the container. Preferably, this circular wiper lip at the inner end of the conical section has the purpose, in particular, of wiping off the stem of the applicator and liberate it as well as possible from the cosmetic adhering to that area. This wiper lip is dimensioned accordingly. In this case, the circular applicator, or the retaining section 2, comprises no bypass opening, i.e. no path that circumvents the wiper lip in order to resupply the cosmetics storage container with air.

Instead, this circular wiper lip is dimensioned in such a way that it has a greater clear diameter than comparable wiper lips, which not only have the task of wiping off the applicator stem, but also the actual applicator body or the bristle covering of the applicator. According to the invention, the size of the clear diameter is selected in such a way that the circular wiper lip wipes off substantially only the applicator stem, and no longer exercises any substantial wiping action on the actual applicator body or the bristle covering of the applicator. The latter is the case if the circular wiper lip keeps so much distance to the core of the applicator to which the bristles are attached, that a sufficient amount of air is able to flow into the cosmetics storage container through the bristle covering that has already been wiped off elsewhere, in order to substantially prevent the annoying "pop" and/or the accompanying squirting or increased deposition of cosmetic on the applicator tip.

In this exemplary embodiment, the applicator stem is preferably dimensioned in such a way that, with the applicator being completely inserted into its storage position, it still protrudes through the circular wiper lip, whereby the cosmetics storage container is completely sealed, so that the stored cosmetic is unable to pass the wiper even if the cosmetics unit is stored, for example, upside-down at higher temperatures, which may involuntarily happen in a handbag.

FIGS. 9 to 12 show a third exemplary embodiment of the invention. This third exemplary embodiment is configured in such a way that the two disc-shaped wiping organs are configured completely as in the first exemplary embodiment, whereas the associated retaining section forms an additional wiping organ, as in the second exemplary embodiment.

The invention claimed is:

1. A wiper for wiping off a cosmetics applicator, with a retaining section for fixing the wiper on a cosmetics storage container, the wiper comprising:

a plurality of wiping organs disposed one behind the other in an operative direction, of which at least one wiping organ is retained on the retaining section or on an adjacent wiping organ in such a way that the at least one wiping organ communicates unimpededly both on its front (V) as well as on its rear (R) with the cosmetics storage container storing a cosmetic; and the retaining section forms a further wiping organ by forming a tubular body which tapers at an end thereof facing into the container, in such a way that the tapered end forms a circular wiper lip which is completely closed in itself in a circumferential direction, and the tubular body is completely closed at its circumference and thereby forms a wiper antechamber which communicates with the cosmetics storage container storing the cosmetic via a wiper opening rimmed by the wiper lip.

2. The wiper according to claim 1, wherein the wiper comprises at least two wiping organs disposed one behind the other in the operative direction, both of which are retained on the retaining section or on the adjacent wiping organ in such a way that both communicate unimpededly both on their front (V) as well as on their rear (R) with the cosmetics storage container storing the cosmetic, or are retained on the retaining section or on the adjacent wiping organ only by a plurality of columns.

3. The wiper according to claim 1, wherein at least one wiping organ of the wiper is/are configured as one or more discs disposed substantially perpendicularly to a longitudinal wiper axis (L).

4. The wiper according to claim 3, wherein one of the wiping organs is configured as a disc that is slitted and another one of the wiping organs is formed by a tubular body which tapers at an end thereof facing into the container in such a way that the tapered end forms a circular wiper lip which is completely closed in itself in a circumferential direction.

5. The wiper according to claim 3, wherein a main surface facing into the container of one or more of said discs is substantially conical.

6. The wiper according to claim 1, wherein at least one wiping organ of the wiper comprises a plurality of slits dividing the respective wiping organ into a plurality of segments, the segments being configured like pieces of cake whose tips are centrally opposite or meet centrally, and which rest against one another with their flanks or are separated only by a small gap.

7. The wiper according to claim 6, wherein the segments of the segmented wiping organ are configured in such a way that the segments form bending beams that are integral with the retaining section, which bend in an elastically yielding manner in a direction of a traction force during withdrawal of the cosmetics applicator, with a spring force counteracting the bending being so large that the segments snap back substantially into their undeflected position already when the cosmetics applicator, during its withdrawal, has passed the respective wiping organ predominantly, but not yet completely.

8. The wiper according to claim 7, wherein a thickness of the segments forming the unilaterally clamped bending beams respectively decreases in a direction from their fixing site towards their free end.

9. The wiper according to claim 6, wherein the slits are at least partially not straight but configured so as to form an S-shaped profile.

10. The wiper according to claim 1, wherein at least one wiping organ of the wiper comprises a central opening which is always open so long as no cosmetics applicator protrudes through the respective wiping organ.

11. A wiper for wiping off a cosmetics applicator, with a retaining section for fixing the wiper on a cosmetics storage container, the wiper comprising:

a plurality of wiping organs disposed one behind the other in an operative direction, of which at least one wiping organ is retained on the retaining section or on an adjacent wiping organ only by a plurality of columns, each of the columns having a longitudinal length that is essentially parallel to a longitudinal axis of the wiper with the longitudinal length of each column being considerably larger than a width of the respective column in a circumferential direction, and the columns are spaced apart from one another.

12. A system comprising a cosmetics storage container and a wiper fixed thereon according to claim 11, wherein at least one wiping organ freely protrudes into an interior of the cosmetics storage container without being in immediate contact with a wall or walls of the cosmetics storage container, the system further comprising a cosmetics applicator.

13. The system according to claim 12, wherein said wiping organ keeps a minimum distance, all around, of at least 1 mm to the wall or walls of the cosmetics storage container.

14. The wiper according to claim 11, wherein at least one wiping organ of the wiper is/are configured as one or more discs disposed substantially perpendicularly to a longitudinal wiper axis (L).

15. The wiper according to claim 14, wherein a main surface facing into the container of one or more of said discs is substantially conical.

16. The wiper according to claim 14, wherein one of the wiping organs is configured as a disc that is slitted and another one of the wiping organs is formed by a tubular body which tapers at an end thereof facing into the container in such a way that the tapered end forms a circular wiper lip which is completely closed in itself in a circumferential direction.

17. The wiper according to claim 11, wherein at least one wiping organ of the wiper comprises a plurality of slits dividing the respective wiping organ into a plurality of segments, the segments being configured like pieces of cake whose tips are centrally opposite or meet centrally, and which rest against one another with their flanks or are separated only by a small gap.

18. The wiper according to claim 17, wherein the segments of the segmented wiping organ are configured in such a way that the segments form bending beams that are integral with the retaining section, which bend in an elastically yielding manner in a direction of a traction force during withdrawal of the cosmetics applicator, with a spring force counteracting the bending being so large that the segments snap back substantially into their undeflected position already when the cosmetics applicator, during its withdrawal, has passed the respective wiping organ predominantly, but not yet completely.

19. The wiper according to claim 18, wherein a thickness of the segments forming the unilaterally clamped bending beams respectively decreases in a direction from their fixing site towards their free end.

20. The wiper according to claim 17, wherein the slits are at least partially not straight but configured so as to form an S-shaped profile.

21. The wiper according to claim 11, wherein at least one wiping organ of the wiper comprises a central opening which is always open so long as no cosmetics applicator protrudes through the respective wiping organ.

22. The wiper according to claim 11, wherein the retaining section forms a further wiping organ by forming a tubular body which tapers at an end thereof facing into the container, in such a way that the tapered end forms a circular wiper lip which is completely closed in itself in a circumferential direction.

23. The wiper according to claim 22, wherein the tubular body is completely closed at its circumference and thereby forms a wiper antechamber which communicates with the cosmetics storage container storing the cosmetic via a wiper opening rimmed by the wiper lip.

* * * * *